United States Patent [19]

Riceman

[11] Patent Number: 5,045,640

[45] Date of Patent: Sep. 3, 1991

[54] CHILD CARE ELECTRICAL OUTLET SAFETY COVER

[75] Inventor: Robert G. Riceman, West Caldwell, N.J.

[73] Assignee: Randolph-Rand Corporation, New York, N.Y.

[21] Appl. No.: 502,282

[22] Filed: Mar. 30, 1990

[51] Int. Cl.[5] ..... H01R 13/447

[52] U.S. Cl. ..... 174/67

[58] Field of Search ..... 174/67; 220/242; 439/136, 142

[56] References Cited

U.S. PATENT DOCUMENTS

| | | | |
|---|---|---|---|
| 4,652,696 | 3/1987 | Winnick | 174/67 |
| 4,740,655 | 4/1988 | Ford | 174/67 |
| 4,803,307 | 2/1989 | Shotey | 174/67 |
| 4,851,612 | 7/1989 | Peckham | 174/67 |
| 4,899,019 | 2/1990 | Riceman | 174/67 |

*Primary Examiner*—Leo P. Picard

*Assistant Examiner*—David A. Tone

*Attorney, Agent, or Firm*—Wenderoth, Lind & Ponack

[57] ABSTRACT

A safety cover for an electrical receptacle has a receiving plate fitting over an electrical receptacle, and a cover assembly having a cover edge extending around the periphery thereof hinged to the receiving plate to pivot between a closed and an open position. The cover assembly has a plurality of locking projections spaced around the periphery of the cover assembly at positions so that they are incapable of simultaneous operation by a hand below a predetermined size. When the cover assembly is closed, locking hooks on the locking projections engage in locking hook apertures in the receiving plate structure and the cover edge is snugly abutted against the receiving plate structure, and the cover assembly can be moved to the open position only by simultaneous deformation of the cover assembly at the positions of the locking hooks sufficient to move the locking hooks sufficientyl far inwardly to free said locking hooks from the locking hook receiving apertures.

3 Claims, 2 Drawing Sheets

CHILD CARE ELECTRICAL OUTLET SAFETY COVER

BACKGROUND OF THE INVENTION

This invention relates to a safety cover for an electrical receptacle, and more particularly, to a combination base-plate and housing member connected by hinging means and capable of being locked so as to prevent access by young children or the like. The invention is designed so that an electrical plug may be plugged into the electrical receptacle while the housing member is in the locked position.

Electrical wall receptacles present much danger to young children and others who make accidential contact with such current-carrying outlets. Compounding this danger is the fact that electrical cords often suffer wear at the area where the cord meets the electrical plug. This is particularly dangerous when the receptacle or plug is exposed to water, as with an outdoor receptacle.

Safety guards designed to prevent unauthorized access to electrical receptacles do currently exist. All, however, are limited in their effectiveness or marketability due to the following reasons.

The simplest form of safety cover currently available consists of a small plastic disk with prongs extending laterally from one of its flat surfaces. This design is effective only against the smallest of children since it can be easily removed by any child physically capable of grasping and pulling an object. This category includes children as young as one year of age. This weakness is further aggravated by the action of removing and replacing these plugs as they are held in place by friction. This friction abrades the plastic prongs as they are repeatedly inserted and removed from the metal contacts within the receptacle.

More sophisticated safety devices also exist such as U.S. Pat. No. 2,526,606 which discloses a protective hood that snaps onto a special base plate. The hood engages the base plate by means of a series of interlocking flanges, each locking flange on the cover having a corresponding receiving flange on the base plate. Removal of the hood is accomplished by flexing one of its two longitudinal edges inwardly to disengage the locking flanges on the hood from those on the base plate. The patent discloses that the hood is made of sufficiently strong material so that the pressure required to release it is more than the average small child can exert. In other words, the effectiveness of this device is limiting a child's access to the receptacle and is totally dependent upon a child's ability to exert enough physical pressure on a single point on the hood. While the average small child may not be able to flex the hood inwardly with his or her hand, it will be appreciated that a small child could, by kicking or striking the hood with a toy or other implement, exert sufficient force to dislodge it from the base plate. Accordingly, protective devices which rely merely upon a child's limited strength may prove ineffective in many situations.

Another approach to the problem of protecting children from hazards associated with electrical outlets has been to cut the power to the outlet entirely when the outlet is exposed. For example, U.S. Pat. No. 2,439,708 which discloses an electrical outlet with a hinged cover box having arms attached thereto which cooperate with a switch that connects the electrical lead wires to the contacts of the outlet. In operation, when the cover box is in the closed position (preventing access to the outlet), the outlet is energized. When this covering box is in its open position (unlatched and swung away from the outlet), the power to the receptacle is shut off.

While it can be appreciated that this feature of turning the power off when the outlet is exposed may be somewhat more effective than other approaches which rely solely on limiting physical access to the outlet, it is also complex and rather costly to implement. Furthermore, repeated opening and closing of the cover box subjects various component parts to wear, eventually requiring the repair or replacement of the entire receptacle. This approach is thus not subject to widespread commercial acceptance or application.

Another approach, more recently advanced, is one which seeks to limit access to an electrical outlet by means of enclosing the outlet. These covering devices consist of a base plate (which replaces the existing outlet cover plate), and either hingedly attached, or removable covers. For example, U.S. Pat. No. 4,070,078 discloses a plate mounted over the electrical outlet to expose the sockets and which has a pair of spaced apart latching elements. These latching elements are hollow and hingedly connected to the plate and are provided with spaced apart flexible abutments engagable with the latching elements for securing the closure elements against different areas of the plate to thereby enclose the sockets and electrical plugs. This approach is complex in design and although it can be seen to be somewhat effective, it still relies totally upon the ability of a child to exert sufficient pressure on the two flexible abutments. This can be accomplished by children as young as two years of age. Another problem which can be readily seen when looking at FIG. 1 of this patent, is that an object, such as a pencil or the like, can be placed in the gap between the two hollow closure elements and used to pry the closure elements open. Also, these closure elements, due to their shape and size, and the fact that they are only held in place by the two clips at the center of the plate, could be dislodged by a small child either by grasping and twisting, or striking one or both of the elements with a toy or other similar object. For these reasons this approach is both too costly for widespread acceptance and may not be sufficiently effective in all situations.

Still another approach to the protection of children from electrical outlets is to both cover the outlet with a protective cover and base plate, which require larger hands and more dexterity than is present in most small children. For example, U.S. Pat. No. 4,652,696 discloses a base plate which replaces the conventional face plate of an electrical outlet, and a cover which is attached to the base plate and is secured to the base plate by three latches which must be simultaneously released to facilitate removal of the cover. It can readily be seen that this approach is, in theory, sound and superior to previous attempts to address this safety hazard. There are, however, several problems with this design, in both of its configurations. The most obvious of these is that the structure would be extremely expensive, if not impossible, to produce, due to the limitations of existing molding and materials technology. This is due to the depth of the cover and base plate sides. Also, because of its straight sided box configuration, a small child, of no more than one year of age, could break the entire structure away from the outlet by either sitting on, climbing on or striking the cover with a foot, toy or other object, thus exposing, not only the outlet and face plate, but the bare electrical wires within the wall. Another problem is with the nature and placement of the retaining latches. These latches are thin and all of the stress exerted, when they are pushed in to disengage the cove, is concentrated in one very small area. Accordingly, with repeated usage, they would lose their elasticity and thus their effectiveness. Also, because of their placement on the sides of the cover, these latches are highly visible and vulnerable to defeat by an inquisitive child using nothing more than a pencil or even a finger.

U.S. Pat. No. 4,603,932 overcomes the problem of the vulnerability of the retaining latches to access by a child and stress concentration by providing latching projections on the edge of the cover which engage in recesses in the receiving plate, but to obtain this engagement, the cover slides with a flange on the receiving plate, which makes the cover difficult to seal against the receiving plate.

My recently granted U.S. Pat. No. 4,899,019 also provides a solution to the problem of the retaining latches by mounting them within the housing as part of an inner housing, but also has the drawback that the outer cover must slide into a flange on the receiving plate so that the device is difficult to seal.

There still exists a need, therefore, for a safety cover which effectively prevents unauthorized access to an electrical receptacle, both when there is a plug in the outlet as well as when there is not, and which can also be easily sealed to prevent water and the like from getting into it so that it can be used out of doors. This device must also be designed in such a way that it can be manufactured, using existing material and technology, in sufficient quantities and at a low enough price as to be capable of the widest possible distribution.

OBJECTS AND BRIEF SUMMARY OF THE INVENTION

Accordingly, it is an object of this invention to provide a safety cover which denies unauthorized access by small children to an electrical receptacle.

It is another object of this invention to provide a safety cover which denies access by small children to an electrical receptacle when the receptacle contains a plug.

It is a still further object of this invention to provide a safety cover which denies access by the elements when the receptacle contains a plug.

According to the present invention, a receiving plate with a hole through its center, of sufficient size as to allow access to the electrical outlet, is affixed to the existing electrical outlet cover plate, for example, by means of an adhesive material. A box-shaped cover assembly is hingedly connected to the receiving plate, thereby enabling the assembly to be closed over the receptacle while the plug is in the outlet. The electrical cord, necessarily attached to the plug, passes through a small hole located on the cover assembly and to its corresponding electrical device.

The cover assembly has extending from it towards the receiving plate a plurality of locking projections having locking hooks thereon and each capable of being moved slightly toward the interior of the assembly. The receiving plate has apertures in a raised flange thereon for receiving the locking hooks, thereby enabling the cover assembly to be interlocked with the receiving plate. The assembly is unlocked, allowing the cover assembly to be pivoted outwardly on its hinges, by simultaneously deforming the cover assembly so that the locking hooks move out of the apertures for the locking hooks.

The cover assembly can be comprised of a box-shaped housing member. The housing member has a hinging means on one side wall, which is hingedly connected to the receiving plate, a second side wall with attached locking hook, a top wall with attached locking hook, a bottom wall with attached locking hook, and a back wall. The three walls which have the locking hooks attached are independently depressible.

The first and second side walls of the cover assembly are preferably parallel to a point approximately one third of the distance toward the back wall, at which point these walls angle inwardly and continue until they join to the back wall of the cover assembly. The top and bottom walls likewise are parallel to a point approximately one third of the distance toward the back wall, at which point these walls angle inwardly until they attach to the back wall of the cover assembly. The locking hooks extend toward the receiving plate, preferably from the center section of the distal edges of the first side wall and the top and bottom side walls. Pushing inwardly on the side walls will cause the locking hooks to be depressed, thereby removing the locking hooks from the means for receiving the locking hooks. To unlock and open or remove the cover assembly from the receiving plate, it is necessary to simultaneously push in on the three side walls which have locking hooks extending from them.

It can be seen, therefore, that locating the locking hooks centrally on the distal edges of three of the four opposing side walls and sufficiently far apart will prohibit unauthorized access. This is true, for example, in the case of children, whose hands are typically too small to reach and depress simultaneously, the central portions of the three side walls of the cover assembly which are adjacent the locking hooks. This central location of the locking hooks also serves to disperse the stresses associated with repeated opening and closing, thus increasing the durability of the device. It can also be seen that the compound angular design of the side walls will increase the amount of pressure necessary to depress the side walls and disengage the locking hooks, further decreasing the possibility of unauthorized access.

DETAILED DESCRIPTION OF THE INVENTION

Figure 1:
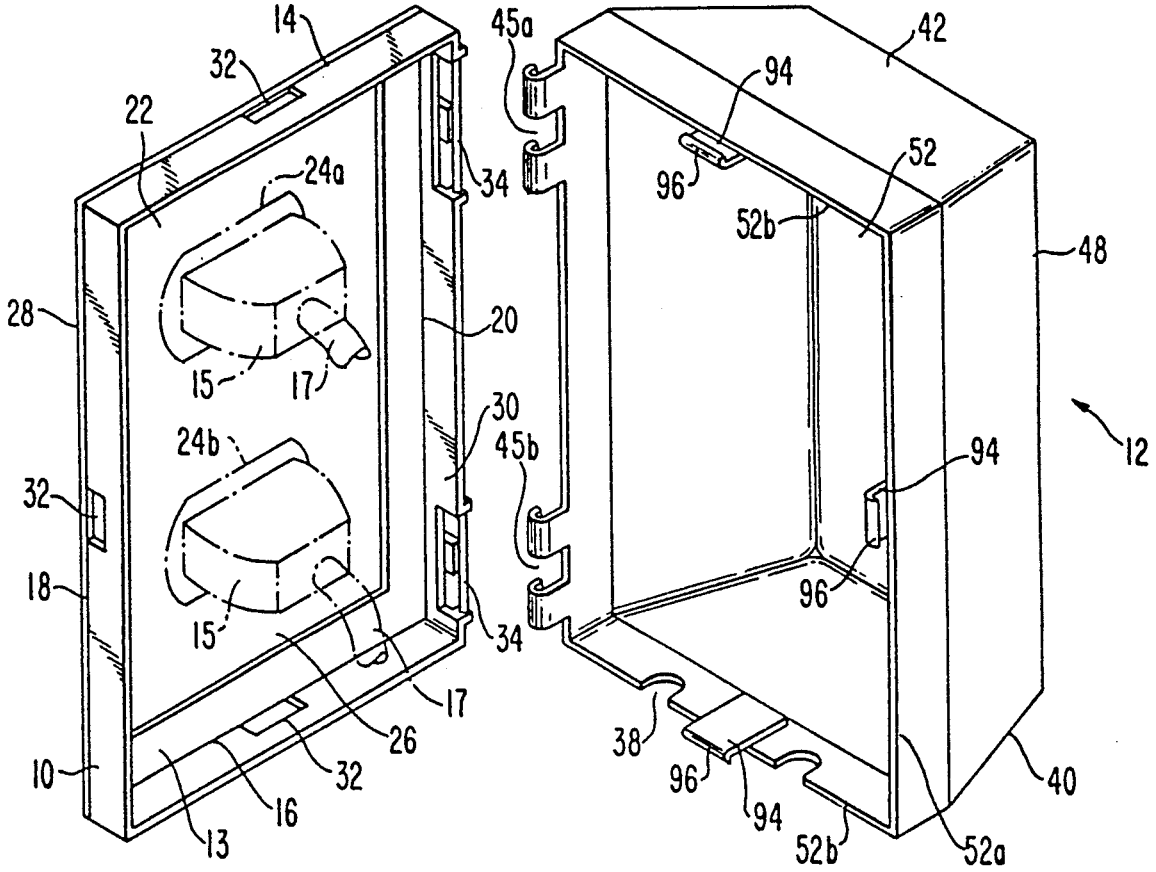
FIG. 1 shows an exploded perspective view of the safety cover of the present invention.

Referring to FIG. 1, a receiving plate 10 is provided for receiving a cover assembly 12, the assembly 12 being comprised of an outer housing member 40.

The receiving plate 10 is preferably rectangular in shape, having a face 13, a top edge 14, a bottom edge 16, a first side edge 18 and a second side edge 20. The plate 10 is designed to fit over a standard electrical receptacle 22, which typically has a pair of electrical outlets 24*a* and 24*b*. The plate 10 has an outlet hole 26 through the attached plate 10. The plate 10 may be attached to the receptacle 22 by an adhesive 28 or other standard means, such as a screw (not shown).

The receiving plate 10 has, along its top edge 14, its bottom edge 16 and its first side edge 18 means for receiving locking hooks 96 on the outer housing member 40. These means may be comprised of a raised flange 30 having through it locking hook receiving apertures 32.

Figure 2:
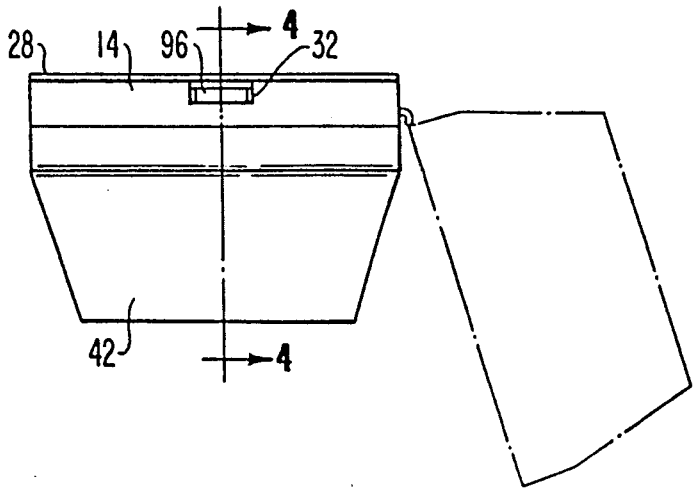
FIG. 2 shows a top view of the safety cover of the present invention in the closed position and showing it in the open position in phantom lines.

Means for hingingly attaching the cover assembly 12 along the second side edge 20 of the plate 10 is also provided. This allows the cover assembly 12 to be swung to a closed position over the receptacle 22 or swung to an open position to allow access to the receptacle, as shown in FIG. 2. This may be comprised of hinge pins 34 located along the raised flange 30 on the second side edge 20, and a pair of connecting hinges 45*a* and 45*b*, located on the housing member 40 which fit around the pins 34, and thereby hingingly attach the cover assembly 12 to the receiving plate 10.

The outer housing member 40 is of a box like shape, and has five walls: a top wall 42, a bottom wall 44 opposite the top wall 42, a first side wall 46, a second side wall 48 opposite the first side wall 46, and a back wall 50. Opposite the back wall 50 is a housing member lateral opening 52 which fits over the face 13 of the receiving plate 10 when the cover assembly 12 is in the closed position. Around the lateral opening 52 is an edge 52*a* having a corner 52*b* at the junction of edge 52*a* and the interior of the housing 40. Each wall 42, 44, 46, 48 and 50 is of a length and width sufficient to provide a housing 40 of size great enough to be occupied by a standard electrical plug 15 and to fit over the face 13 of the receiving plate 10. The front and second side walls 46 and 48 are parallel to a point approximately one third of the distance toward the back wall 50, at which point these walls angle inwardly and continue until they join the back wall 50. The top and bottom walls 42 and 44 are similarly shaped.

Figure 4:
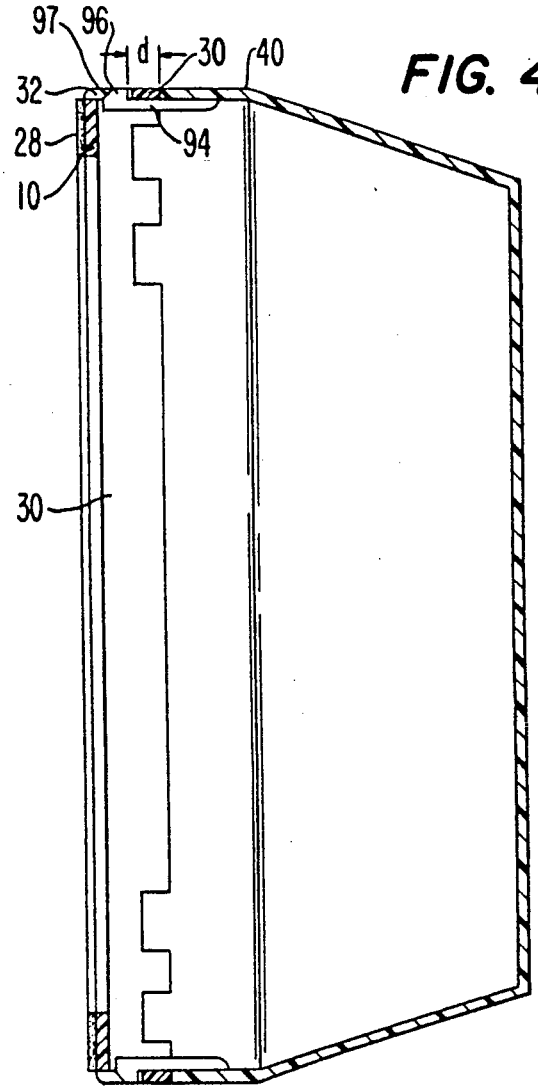
FIG. 4 is a sectional view taken on line 4—4 of FIG. 2.

Located about the middle of the edge of each wall 42, 44 and 48 are locking means in the form of projections 94. The locking projections 94 extend out of the lateral opening 52 at the corner 52*b* of the edge 52*a* of the housing member 40, and they have locking hooks 96 at their face ends. The locking hooks 96 extend transversely of edge 52*a* and they are spaced along projections 94 a distance d substantially equal to the distance from the free edge of flange 30 to the edges of aperture 32 which is closest to the free edge of flange 30. As a result, the hooks 96 engage in the receiving holes 32 of the receiving plate 10 when the housing member 40 is swung to the closed position, thereby holding the cover assembly 12 in a locked position with the edge 52*a* against the edge of flange 30 of the receiving plate 10 as shown in FIG. 4. An inclined surface 97 located on the side of the hook 96 engaging the raised flange 30 as the housing member 40 does causes the hooks 96 to be easily forced inwardly of the flange 30 and then slid along the inner surface of flange 30 and into the receiving hole 32.

As a result, the edge 52*a* engaging the free edge of flange 30 with a tight fit produces some sealing effect. A water-tight seal can be easily formed by placing a sealing material on one or both edges. The simultaneous inward depression of walls 42, 44 and 48 in turn causes projections 94 to be moved inwardly and hooks 96 to be removed from the holes 32. The cover assembly 12 can then be swung around its hinged side and brought to the open position, and the plug 15 and receptacle 22 exposed.

The dimensions of the cover assembly 12 allows the apparatus to cover a receptacle while a plug 15 is inserted into an outlet 24*a*, 24*b*. At least one cord aperture 38 is located in the bottom wall 44 of the outer housing member 40 to form a passage through which an electrical cord 17 attached to the plug can be passed.

It is clear, therefore, that an appliance or other electrically operated device can be safely plugged into an outlet without the fear that a small child or the elements may gain access. Only a person having a hand of size large enough to depress all three buttons simultaneously can gain access.

The central position of the locking hooks 96 along the edges of walls 42, 44 and 48 disperses the stress and strain in the material of the housing 40 which is associated with repeated opening and closing of the housing member 40.

The compound angular design of the side walls of the housing member 40 increases the amount of pressure necessary to depress the side walls to disengage the locking hooks 96, further reducing the possibility of unauthorized access to the receptacle.

What is claimed is:

1. A safety cover for an electrical receptacle, comprising:

a receiving plate capable of being affixed to an electrical receptacle for lockingly receiving a cover assembly, said receiving plate having a raised flange extending along the edge thereof and having a free edge;

a cover assembly having a lateral opening with a peripheral shape corresponding to the shape of said raised flange and a cover edge extending around the periphery of said lateral opening and having a corner at the junction of said edge and the interior of said cover assembly, said cover assembly being hinged to said receiving plate for pivoting movement relative to said receiving plate between a closed position in which said cover edge abuts said free edge of said raised flange and an open position in which said cover edge is spaced from said raised flange to expose and electrical receptacle when said receiving plate is attached thereto, said cover assembly having at least three locking means spaced around the periphery of said lateral opening at positions other than a position adjacent the hinged connected of said cover assembly to said receiving plate, the spacing of said locking means being sufficient for making said locking means incapable of simultaneous operation by a hand below a predetermined size, said raised flange having a locking hook receiving aperture therein extending substantially transversely of said raised flange at a position along said raised flange corresponding to the positions of each of said locking means along the periphery of said lateral opening, said locking means having a locking projection extending out of said lateral opening at said corner of said cover edge and having a free end with a locking hook thereon which extends transversely of said locking projection in the direction of the transverse dimension of said cover edge and which is spaced along said projection from said cover edge a distance substantially equal to the distance from the free edge of said raised flange to the edge of said locking hook receiving aperture which is closest to said free edge, whereby when said cover assembly is moved to the closed position, said locking hooks are engaged in said locking hook receiving apertures and said cover edge is snugly abutted against the free edge of said raised flange, and said cover assembly can be moved to the open position only by simultaneous deformation of said cover assembly at the positions of said locking means sufficient to move said locking hooks sufficiently far inwardly of said raised flange to free said locking hooks from said locking hook receiving apertures.

2. A safety cover as claimed in claim 1 in which said cover assembly comprises a cover member having spaced opposed upper and lower walls and spaced opposed side walls joining said upper and lower walls, one of the edges of said thus joined walls defining said lateral opening and the other of the edges having a rear wall joined thereto closing said cover member, each of said upper, lower and side walls having a portion adjacent said lateral opening parallel to the opposed wall and having a portion angled inwardly of said cover member to said rear wall.

3. A safety cover as claimed in claim 2 in which the dimension of said parallel portion of each of said upper, lower and side walls is about one third of the distance from said lateral opening to said rear wall.

* * * * *

UNITED STATES PATENT AND TRADEMARK OFFICE

CERTIFICATE OF CORRECTION

PATENT NO. : 5,045,640

DATED : September 3, 1991

INVENTOR(S) : Robert G. RICEMAN

It is certified that error appears in the above-identified patent and that said Letters Patent is hereby corrected as shown below:

In the abstract, line 17, for "sufficientyl" read --sufficiently--.

Column 1, line 65, delete "which".

Figure 3:
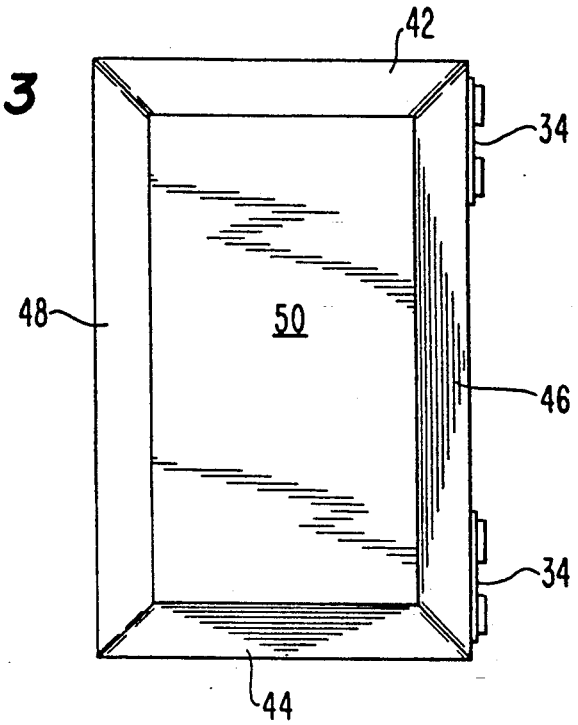
FIG. 3 is a front plan view of the safety cover of the present invention.

Column 5, line 22, preceding "the" read --as shown in Fig. 3,--.

Column 6, line 50, for "connected" read --connection--.

Signed and Sealed this

Ninth Day of March, 1993

*Attest:*

STEPHEN G. KUNIN

*Attesting Officer*

*Acting Commissioner of Patents and Trademarks*